US007551146B2

(12) United States Patent
Pan et al.

(10) Patent No.: US 7,551,146 B2
(45) Date of Patent: Jun. 23, 2009

(54) CONFIGURABLE ANTENNA FOR MIXED WIRELESS NETWORKS

(75) Inventors: Helen Kankan Pan, Portland, OR (US); James Tsai, Beaverton, OR (US); Stuart A Golden, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 118 days.

(21) Appl. No.: 11/731,646

(22) Filed: Mar. 30, 2007

(65) Prior Publication Data

US 2008/0238794 A1 Oct. 2, 2008

(51) Int. Cl.
*H01Q 3/24* (2006.01)

(52) U.S. Cl. ..... 343/876; 343/700 MS; 343/702

(58) Field of Classification Search ..... 343/700 MS, 343/702, 876
See application file for complete search history.

(56) References Cited

U.S. PATENT DOCUMENTS

| | | | | |
|---|---|---|---|---|
| 7,298,340 | B2 * | 11/2007 | Ohba | 343/702 |
| 7,321,335 | B2 * | 1/2008 | Egorov | 343/702 |
| 2006/0262015 | A1 * | 11/2006 | Thornell-Pers et al. | 343/702 |
| 2007/0109203 | A1 * | 5/2007 | Park et al. | 343/702 |

* cited by examiner

*Primary Examiner*—Hoang V Nguyen
(74) *Attorney, Agent, or Firm*—Caven & Aghevli LLC

(57) ABSTRACT

Methods and apparatus to reconfigure an antenna for use with mixed wireless networks are described. In one embodiment, a switch is coupled between a first portion and a second portion of an antenna to cause the antenna to tune to a plurality of radio frequency bands. Other embodiments are also described.

12 Claims, 4 Drawing Sheets

CONFIGURABLE ANTENNA FOR MIXED WIRELESS NETWORKS

BACKGROUND

The present disclosure generally relates to the field of electronics. More particularly, an embodiment of the invention generally relates to a configurable antenna for use with mixed wireless networks.

Some wireless devices may utilize one or more antennas for each communication radio within the device. For example, a mobile phone may include one antenna for receiving radio signals from a cellular tower and another antenna for communicating with WLAN devices. Many WLAN devices use two, three or even more different antennas to improve the communication reliability of the link or throughput. As the number of different radio signal types increases and the need for better communication reliability increases, the number of antennas that a wireless device has to support keeps increasing.

With the addition of multiple antennas comes a number of significant problems. First, the physical space requirement of the antennas becomes significant. If uncontrolled, then this requirement may grow the physical dimensions of the wireless device. Second, in certain form factors (such as a laptop), the antennas and radio modules are separated by a RF cable going through a hinge. As the number of antennas increases, the number of RF cables through the hinge increase. If uncontrolled, the hinge may need to grow as well.

BRIEF DESCRIPTION OF THE DRAWINGS

The detailed description is provided with reference to the accompanying figures. In the figures, the left-most digit(s) of a reference number identifies the figure in which the reference number first appears. The use of the same reference numbers in different figures indicates similar or identical items.

DETAILED DESCRIPTION

In the following description, numerous specific details are set forth in order to provide a thorough understanding of various embodiments. However, various embodiments of the invention may be practiced without the specific details. In other instances, well-known methods, procedures, components, and circuits have not been described in detail so as not to obscure the particular embodiments of the invention. Further, various aspects of embodiments of the invention may be performed using various means, such as integrated semiconductor circuits ("hardware"), computer-readable instructions organized into one or more programs ("software"), or some combination of hardware and software. For the purposes of this disclosure reference to "logic" shall mean either hardware, software, or some combination thereof.

Reference in the specification to "one embodiment" or "an embodiment" means that a particular feature, structure, or characteristic described in connection with the embodiment may be included in at least an implementation. The appearances of the phrase "in one embodiment" in various places in the specification may or may not be all referring to the same embodiment. Also, in the description and claims, the terms "coupled" and "connected," along with their derivatives, may be used. In some embodiments of the invention, "connected" may be used to indicate that two or more elements are in direct physical or electrical contact with each other. "Coupled" may mean that two or more elements are in direct physical or electrical contact. However, "coupled" may also mean that two or more elements may not be in direct contact with each other, but may still cooperate or interact with each other.

Figure 1:
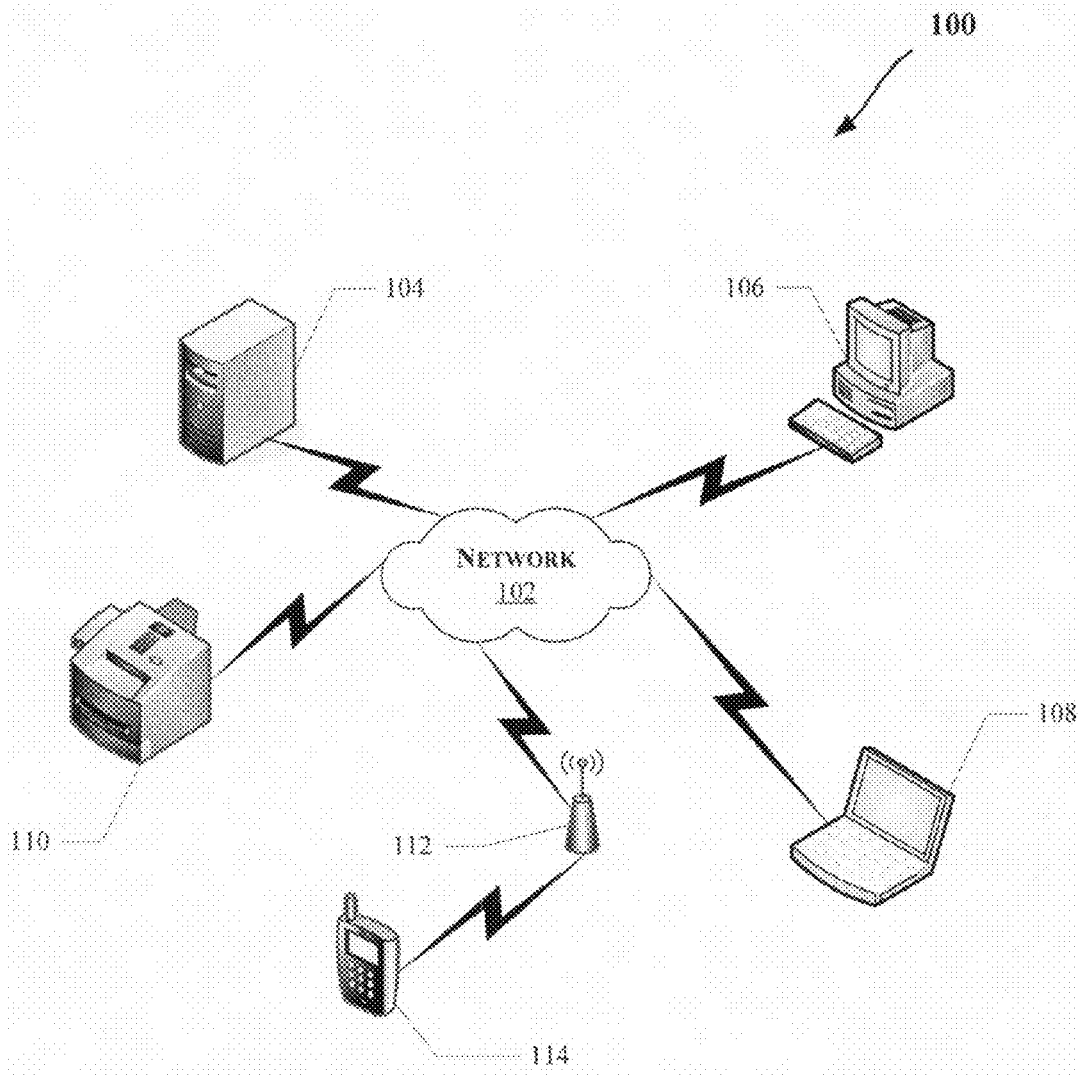
FIGS. 1-2 illustrate various components of embodiments of communication systems which may be utilized to implement one or more embodiments.

Some of the embodiments discussed herein may be applied in various computing environments such as those discussed with reference to FIGS. 1-6. More particularly, FIG. 1 illustrates various components of an embodiment of a communication system 100, which may be utilized to implement some embodiments discussed herein. The system 100 may include a network 102 to enable communication between various devices such as a server computer 104, a desktop computer 106 (e.g., a workstation or a desktop computer), a laptop (or notebook) computer 108, a reproduction device 110 (e.g., a network printer, copier, facsimile, scanner, all-in-one device, etc.), a wireless access point 112, a personal digital assistant or smart phone 114, a rack-mounted computing system (not shown), etc. The network 102 may be any type of type of a computer network including an intranet, the Internet, and/or combinations thereof.

The devices 104-114 may communicate with the network 102 through wired and/or wireless connections. Hence, the network 102 may be a wired and/or wireless network. For example, as illustrated in FIG. 1, the wireless access point 112 may be coupled to the network 102 to enable other wireless-capable devices (such as the device 114) to communicate with the network 102. In some embodiments, more than one access point 112 may be in communication with the network 102. In one embodiment, the wireless access point 112 may include traffic management capabilities. Also, data communicated between the devices 104-114 may be encrypted (or cryptographically secured), e.g., to limit unauthorized access. The network 102 may utilize any communication protocol such as Ethernet, Fast Ethernet, Gigabit Ethernet, wide-area network (WAN), fiber distributed data interface (FDDI), Token Ring, leased line, analog modem, digital subscriber line (DSL and its varieties such as high bit-rate DSL (HDSL), integrated services digital network DSL (IDSL), etc.), asynchronous transfer mode (ATM), cable modem, and/or FireWire.

Wireless communication through the network 102 may be in accordance with one or more of the following: wireless local area network (WLAN), wireless wide area network (WWAN), code division multiple access (CDMA) cellular radiotelephone communication systems, global system for mobile communications (GSM) cellular radiotelephone systems, North American Digital Cellular (NADC) cellular radiotelephone systems, time division multiple access (TDMA) systems, extended TDMA (E-TDMA) cellular radiotelephone systems, third generation partnership project (3G) systems such as wide-band CDMA (WCDMA), etc. Moreover, network communication may be established by internal network interface devices (e.g., present within the same physical enclosure as a computing system) such as a network interface card (NIC) or external network interface devices (e.g., having a separate physical enclosure and/or power supply than the computing system to which it is coupled).

Figure 2:
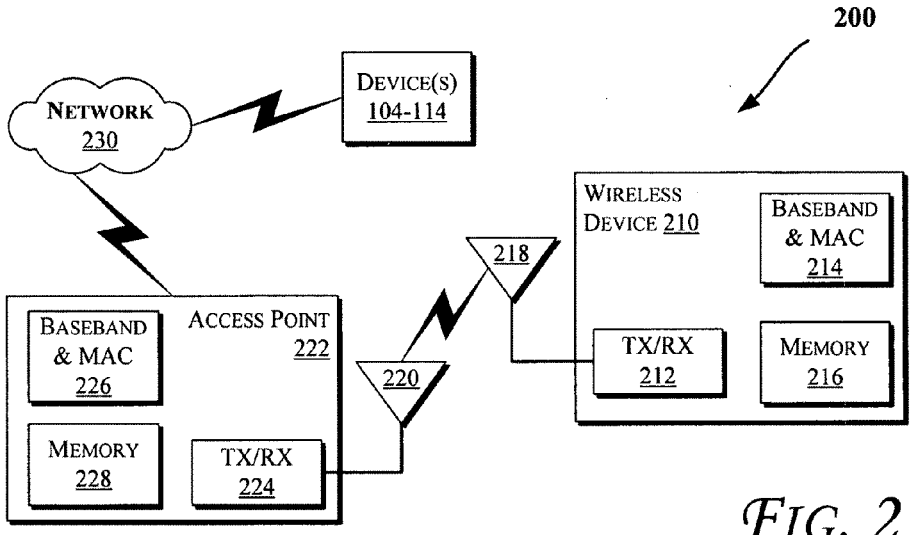

Referring to FIG. 2, a block diagram of a wireless local area or cellular network communication system 200 in accordance with one or more embodiments of the invention will be discussed. In the communication system 200 shown in FIG. 2, a wireless device 210 may include a wireless transceiver 212 to couple to an antenna 218 and to a logic 214 such as a processor (e.g., to provide baseband and media access control (MAC) processing functions). In some embodiment, one or more of the devices 104, 106, 108, 110, or 114 of FIG. 1 may include one or more of the components discussed with reference to the wireless device 210. Hence, in an embodiment, the devices 104, 106, 108, 110, or 114 of FIG. 1 may be the same or similar to the wireless device 210. In one embodiment of the invention, wireless device 210 may be a cellular telephone or an information handling system such as a mobile personal computer or a personal digital assistant or the like that incorporates a cellular telephone communication module. Logic 214 in one embodiment may comprise a single processor, or alternatively may comprise a baseband processor and an applications processor. Logic 214 may couple to a memory 216 which may include volatile memory such as dynamic random-access memory (DRAM), non-volatile memory such as flash memory, or alternatively may include other types of storage such as a hard disk drive. Some portion or all of memory 216 may be included on the same integrated circuit as logic 214, or alternatively some portion or all of memory 216 may be disposed on an integrated circuit or other medium, for example a hard disk drive, that is external to the integrated circuit of logic 214.

Wireless device 210 may communicate with access point 222 via a wireless communication link, where access point 222 may include one or more of: an antenna 220, a transceiver 224, a processor 226, and a memory 228. In some embodiments, the device 210 may directly communicate with other devices capable of wireless communication (e.g., having the same or similar components as discussed with reference to device 210), instead or in addition to communication via the access point 222. In one embodiment, access point 222 may be a base station of a cellular telephone network, and in an embodiment, access point 222 may be a an access point or wireless router of a wireless local or personal area network. In some embodiment, the access point 112 of FIG. 1 may include one or more of the components discussed with reference to the access point 222. Hence, in an embodiment, the access point 112 of FIG. 1 may be the same or similar to the access point 222. In an embodiment, access point 222 (and optionally wireless device 210) may include two or more antennas, for example to provide a spatial division multiple access (SDMA) system or a multiple input, multiple output (MIMO) system. Access point 222 may couple with network 230 (which may be the same or similar to the network 102 of FIG. 1 in some embodiments), so that wireless device 210 may communicate with network 230, including devices coupled to network 230 (e.g., one or more of the devices 104-114), by communicating with access point 222 via a wireless communication link. Network 230 may include a public network such as a telephone network or the Internet, or alternatively network 230 may include a private network such as an intranet, or a combination of a public and a private network. Communication between wireless device 210 and access point 222 may be implemented via a wireless local area network (WLAN). In one embodiment, communication between wireless device 210 and access point 222 may be at least partially implemented via a cellular communication network compliant with a Third Generation Partnership Project (3GPP or 3G) standard. In some embodiments, antenna 218 may be utilized in a wireless sensor network or a mesh network.

Figure 3:
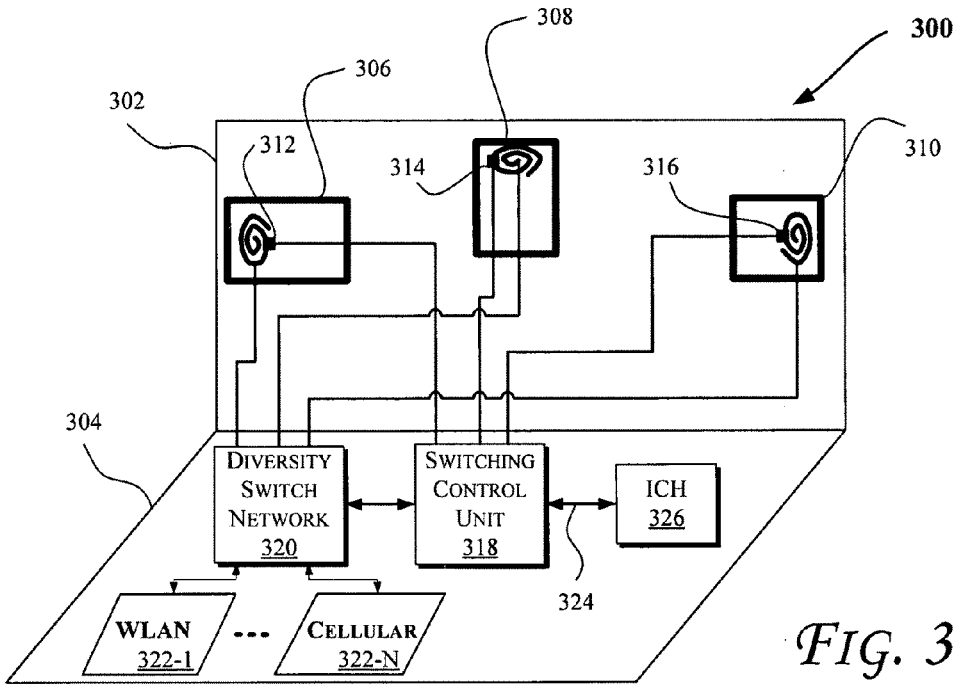
FIGS. 3 and 6 illustrate block diagrams of embodiments of computing systems, which may be utilized to implement various embodiments discussed herein.

FIG. 3 illustrates a block diagram of a computing system 300, according to an embodiment. In various embodiments, one or more of the devices 104-114 of FIG. 1 and/or devices 210 or 222 of FIG. 2 may include one or more components of the system 300. For example, the system 300 may correspond to a mobile computing device (e.g., a laptop) in an embodiment.

As illustrated in FIG. 3, the system 300 may include a lid 302 (which may house a display such as a liquid crystal display (LCD) or other thin flat-panel display device(s)) and a main board 304 (which may include various logic blocks). The lid 302 may include one or more antennas such as antennas 306-310. Each antenna 306-310 may include one or more portions that are coupled via one or more switches 312-316. The switches 312-316 may be any type of a switch whose state (e.g., on or off) may be controlled via electrical signals, such as a pin diode, a field effect transistor (FET) (such as a metal oxide semiconductor field effect transistor (MOSFET), or a micro-electromechanical systems (MEMS) element. In an embodiment, a switching control unit 318 may control the state of the switches 312-316. For example, if the switch 312 is turned on (e.g., at 3.3V), the entire length of the element of antenna 306 may be utilized for tuning to a corresponding radio frequency; whereas when the switch 312 is turned off (e.g., at 0V), a portion (rather than the entire length) of the antenna 306 may be used for tuning to a corresponding radio frequency.

Moreover, even though FIG. 3 only shows a single switch coupling a first portion and a second portion of the same antenna element, additional switches may be utilized to couple various portions of the antenna elements (e.g., two switches may be used to couple three portions of the antenna element). Hence, the antennas 306-310 may be reconfigurable (e.g., via the switching control unit 318) to various radio frequencies, radiation patterns, and/or polarization.

The system 300 may also include a diversity switch network 320 coupled to one or more radios 322-1 through 322-N on the platform (of which two are shown in FIG. 3 for simplicity). The switching control unit 318 may communicate with other components of the system 300 (such as one or more of the components discussed with reference to FIG. 6) through an interconnect 324 (e.g., a low pin count (LPC) interface) which may communicate via an input/output control hub (ICH) 326 (such as the ICH discussed with reference to FIG. 6). In an embodiment, the interconnect 324 may be independent of the software or firmware that may control the operation of the logic 318. The diversity switch network 320 may communicate with different wireless RF modules (e.g., 322-1 through 322-N) and switch antenna connections between the radio modules and the antenna elements.

In some embodiments, the system shown in FIG. 3 may have a reconfigurable antenna design where the diversity switch network 302 is not utilized. One embodiment of the diversity switch network may simply pass the signals through the diversity switch network without change and without comprising of any switches at all. That is, one can think of this diversity switch network performing an identity matrix transformation. Moreover, the system 300 may be used to provide an M×N (where M is the number of antennas (such as Antennas 306-310) and N is the number of RF modules (such as modules 322-1 through 322-N)) enabled reconfigurable antenna architecture for cellular and multi-input multi-output (MIMO) WLAN RF modules on laptop platforms. Furthermore, the architecture of system 300 may provide several solutions such as: (1) minimize the space allocation for the antennas; (2) minimize the number of radio frequency (RF) cables through the hinges that may couple the lid 302 and the main board 304; (3) add diversity to radios that do not have diversity designed into the system; and/or (4) reduce the out-of-band rejection by reconfiguring the antenna element rather than supporting a single element that needs multiple bands. In various embodiments, the diversity logic 320 may support scalable single-input single-output (SISO) to MIMO topologies and may further provide switch diversity to select the best antenna performance and multi-radio simultaneous operation.

In accordance with some embodiments, implementing the M×N enabled reconfigurable antenna architecture may be a useful component to design and realize a software defined radio (SDR). Furthermore, in various embodiments of the invention, the operations discussed herein, e.g., with reference to FIGS. 1-6, may be implemented as hardware (e.g., logic circuitry), software, firmware, or combinations thereof, which may be provided as a computer program product, e.g., including a machine-readable or computer-readable medium having stored thereon instructions (or software procedures) used to program a computer to perform a process discussed herein. The machine-readable medium may include a storage device such as those discussed with respect to FIGS. 1-6. Additionally, such computer-readable media may be downloaded as a computer program product, wherein the program may be transferred from a remote computer (e.g., a server) to a requesting computer (e.g., a client) by way of data signals embodied in a carrier wave or other propagation medium via a communication link (e.g., a bus, a modem, or a network connection). Accordingly, herein, a carrier wave shall be regarded as comprising a machine-readable medium.

In an embodiment, software features may include one or more of the following: (1) M×N trigger—adaptive tuning reconfigurable antenna (e.g., antennas 306-310) and switching logic (318) to support different usage scenarios; (2) software cellular antenna switch diversity (e.g., via logic 320); (3) M×N handoff management—seamless connection; (4) M×N link management; and/or (5) M×N information services—acquire available network nearby for example.

Figure 4:
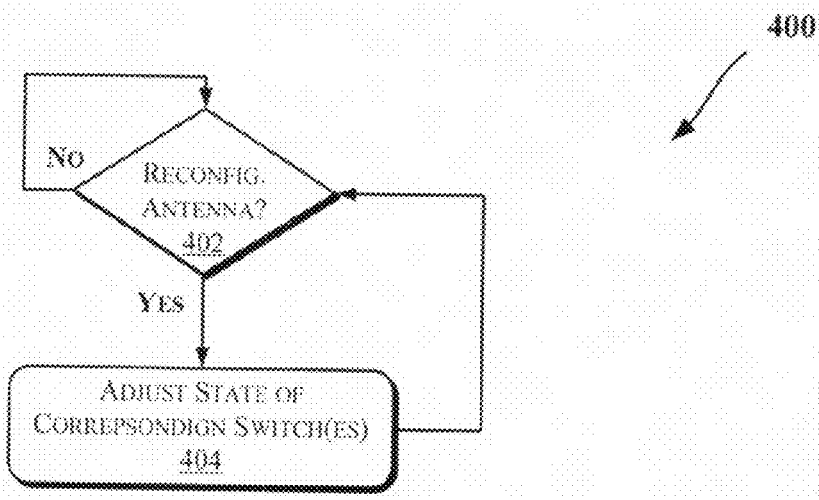
FIG. 4 illustrates a flow diagram of a method, according to an embodiment of the invention.

FIG. 4 illustrates a block diagram of an embodiment of a method 400 to reconfigure an antenna. In an embodiment, the method 400 may be used to reconfigure the antennas 218-220 of FIG. 2 and/or 306-310 of FIG. 3. In an embodiment, various components discussed with reference to FIGS. 1-3 and 5-6 may be utilized to perform one or more of the operations discussed with reference to FIG. 4.

Referring to FIGS. 1-4, at an operation 402, it may be determined whether an antenna is to be reconfigured. For example, the switching control unit 318 may receive a signal (e.g., through ICH 326) to request reconfiguration of one or more of the antennas 306-310. As discussed with reference to FIG. 3, software/firmware may be executing on the platform (e.g., on a processor such as those discussed with reference to FIG. 2 or 6) that request an antenna reconfiguration at operation 402. At an operation 404, a corresponding switch (e.g., one or more of the switches 3012-316) may be adjusted such as discussed with reference to FIG. 3.

Figure 5:
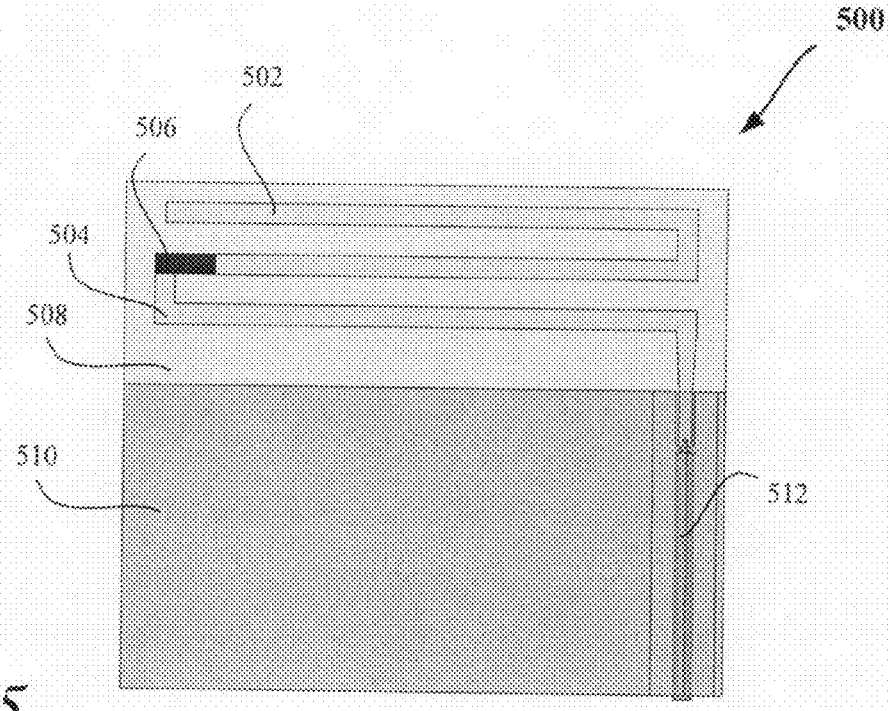
FIG. 5 illustrates a configurable antenna, according to an embodiment.

FIG. 5 illustrates a configurable antenna 500 in accordance with an embodiment of the invention. In an embodiment, the antennas of FIG. 2 (e.g., antennas 218-220) and 3 (e.g., antennas 306-310) may be the same or similar to the antenna 500. The antenna 500 may include one or more portions (e.g., 502 and 504) which may be coupled via a switch 506 depending on the state of the switch 506. In some embodiments, the portions 502-504 may be constructed with a material comprising one or more of: Aluminum, Copper, Gold, or combinations thereof. In an embodiment, the switch 506 may be the same or similar to the switches 312-316 of FIG. 3. The antenna 500 may include a substrate 508, e.g., to mechanically support the antenna portions 502-504 and switch 506. The substrate 508 may be constructed of flexible dielectric material (e.g., Kapton® polyimide film). The antenna 500 may further include a ground portion 510 that may be constructed with any electrically conductive material such as Aluminum, Copper, Gold, or combinations thereof. A cable 512 (e.g., a coaxial cable) may couple various components of a computing system (e.g., the system 300 of FIG. 3) to the antenna portion 504. Also, the switch 506 may be coupled to select components (not shown) such as discussed with reference to FIG. 3. Additionally, in some embodiments, the antenna 500 may be any of: a monopole antenna, a planar inverted F antenna (PIFA), a slot antenna, a micro-strip patch antenna, or a fractal antenna.

Some of the embodiments discussed herein, e.g., with reference to FIGS. 1-6, may be used to enable reconfigurable antennas for multiple radios. The antennas may be reconfigurable via switch(es) that are controlled via software, e.g., in the MAC layer or the application layer. Such embodiments may provide reliability, flexibility, and/or capacity increases. The reconfigurable antenna may be constructed with RF switches such as pin diodes, FETs, or MEMs to vary the antenna radiation electrical length, or current flowing path on structure. By adjusting the operating frequency and radiation patterns and polarization, a reconfigurable antenna may be capable of accommodating various requirements for wireless communication systems. For example, a single computing system may be capable of supporting multi-radios collocated in the same platform such as WiFi (e.g., in accordance with Wireless Fidelity (Institute of Electrical & Electronics Engineers (IEEE) 802.11 wireless networking, for example, in compliance with Information technology—Telecommunications and information exchange between systems—Local and metropolitan area networks—Specific requirements—Part 11: Wireless LAN Medium Access Control (MAC) and Physical Layer (PHY) Specifications. 1999-2003 and any other revisions thereof)), WiMax (e.g., in accordance with IEEE 802.16e wireless broadband standard, for example, in compliance with IEEE Standard for Local and metropolitan area networks Part 16: Air Interface for Fixed and Mobile Broadband Wireless Access Systems Amendment for Physical and Medium Access Control Layers for Combined Fixed and Mobile Operation in Licensed Bands, 2005 and any other revisions thereof)), Bluetooth®, ultra-wide bandwidth (UWB), WCDMA. In an embodiment, instead of allocating one antenna or N antennas to support MIMO for each RF subsystem, reconfigurable antenna(s) may adaptively tune to different frequencies, radiation patterns, and polarizations, for example, to meet the requirement of any wireless communication. When simultaneous multiple-radio operation is needed, several techniques may be used. First, reconfigurable antennas may be realized by fast switching, at the packet level. That is, the system uses a particular radio and antenna to communicate and then quickly change the radio and antenna configuration to communicate with a different communication standard. Another approach would be to support simultaneous operation of multiple radios by reducing the number of antennas that are being utilized for a particular radio and reallocating them to a different radio. For example, IEEE 802.11n (which may comply with IEEE 802.11n specification, which may be a part of the above mentioned IEEE 802.11 standard) WLAN utilizes 3 antennas for full MIMO support. When simultaneous operation of WLAN and 3G are required then WLAN support can reduce to 2 antennas providing the ability to utilize the third antenna for 3G.

Figure 6:
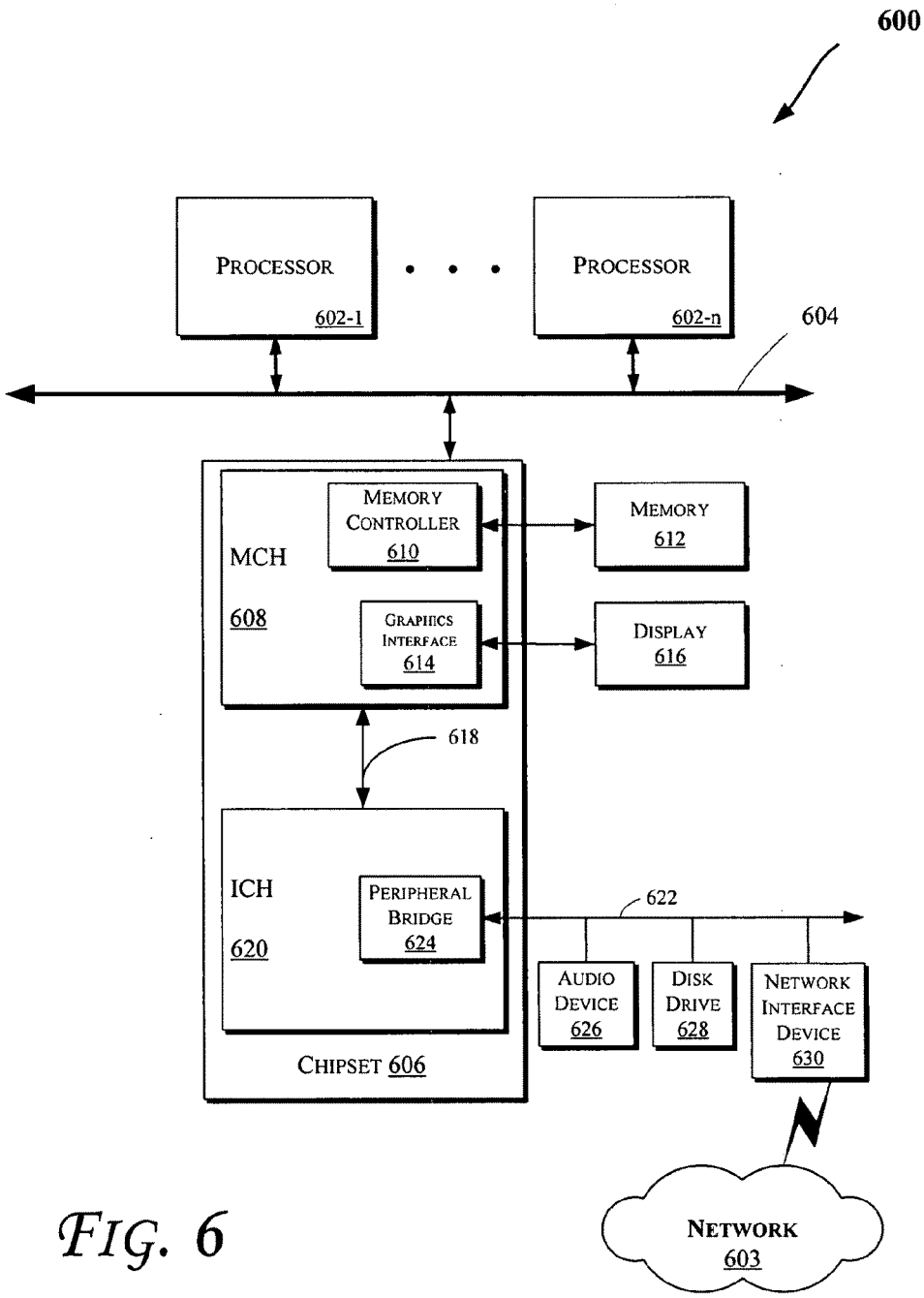

FIG. 6 illustrates a block diagram of an embodiment of a computing system 600. One or more of the devices 104-114 of FIG. 1, devices 210 or 222 of FIG. 2, and/or computing system 300 of FIG. 3 may comprise one or more of the components of the computing system 600. The computing system 600 may include one or more central processing unit (s) (CPUs) 602 or processors that communicate via an interconnection network (or bus) 604. The processors 602 may include a general purpose processor, a network processor (that processes data communicated over a computer network 603), or other types of a processor (including a reduced instruction set computer (RISC) processor or a complex instruction set computer (CISC)). Moreover, the processors 602 may have a single or multiple core design. The processors 602 with a multiple core design may integrate different types of processor cores on the same integrated circuit (IC) die. Also, the processors 602 with a multiple core design may be implemented as symmetrical or asymmetrical multiprocessors. Moreover, the operations discussed with reference to FIGS. 1-5 may be performed by one or more components of the system 600.

A chipset 606 may also communicate with the interconnection network 604. The chipset 606 may include a memory control hub (MCH) 608. The MCH 608 may include a memory controller 610 that communicates with a memory 612. The memory 612 may store data, including sequences of instructions that are executed by the CPU 602, or any other device included in the computing system 600. In one embodiment of the invention, the memory 612 may include one or more volatile storage (or memory) devices such as random access memory (RAM), dynamic RAM (DRAM), synchronous DRAM (SDRAM), static RAM (SRAM), or other types of storage devices. Nonvolatile memory may also be utilized such as a hard disk. Additional devices may communicate via the interconnection network 604, such as multiple CPUs and/or multiple system memories.

The MCH 608 may also include a graphics interface 614 that communicates with a display 616. In one embodiment of the invention, the graphics interface 614 may communicate with the display 616 via an accelerated graphics port (AGP). In an embodiment of the invention, the display 616 may be a flat panel display that communicates with the graphics interface 614 through, for example, a signal converter that translates a digital representation of an image stored in a storage device such as video memory or system memory into display signals that are interpreted and displayed by the display 616. The display signals produced by the interface 614 may pass through various control devices before being interpreted by and subsequently displayed on the display 616.

A hub interface 618 may allow the MCH 608 and an input/output control hub (ICH) 620 to communicate. The ICH 620 may provide an interface to I/O devices that communicate with the computing system 600. The ICH 620 may communicate with a bus 622 through a peripheral bridge (or controller) 624, such as a peripheral component interconnect (PCI) bridge, a universal serial bus (USB) controller, or other types of peripheral bridges or controllers. The bridge 624 may provide a data path between the CPU 602 and peripheral devices. Other types of topologies may be utilized. Also, multiple buses may communicate with the ICH 620, e.g., through multiple bridges or controllers. Moreover, other peripherals in communication with the ICH 620 may include, in various embodiments of the invention, integrated drive electronics (IDE) or small computer system interface (SCSI) hard drive(s), USB port(s), a keyboard, a mouse, parallel port(s), serial port(s), floppy disk drive(s), digital output support (e.g., digital video interface (DVI)), or other devices.

The bus 622 may communicate with an audio device 626, one or more disk drive(s) 628, and a network interface device 630, which may be in communication with the computer network 603. In an embodiment, the device 630 may be a NIC capable of wireless communication. In an embodiment, the network 603 may be the same or similar to the networks 102 of FIG. 1 and/or 230 of FIG. 2. In one embodiment, the network interface device 630 may include one or more components of the wireless device 210 of FIG. 2 or the system 300 of FIG. 3. Also, the device 630 may be the same or similar to the device 210 of FIG. 2 in some embodiments. Other devices may communicate via the bus 622. Additionally, various components (such as the network interface device 630) may communicate with the MCH 608 in some embodiments of the invention. In addition, the processor 602 and the MCH 608 may be combined to form a single chip. Furthermore, the graphics interface 614 may be included within the MCH 608 in other embodiments of the invention.

Furthermore, the computing system 600 may include volatile and/or nonvolatile memory (or storage). For example, nonvolatile memory may include one or more of the following: read-only memory (ROM), programmable ROM (PROM), erasable PROM (EPROM), electrically EPROM (EEPROM), a disk drive (e.g., 628), a floppy disk, a compact disk ROM (CD-ROM), a digital versatile disk (DVD), flash memory, a magneto-optical disk, or other types of nonvolatile machine-readable media that are capable of storing electronic data (e.g., including instructions). In an embodiment, components of the system 600 may be arranged in a point-to-point (PtP) configuration. For example, processors, memory, and/or input/output devices may be interconnected by a number of point-to-point interfaces.

Thus, although embodiments of the invention have been described in language specific to structural features and/or methodological acts, it is to be understood that claimed subject matter may not be limited to the specific features or acts described. Rather, the specific features and acts are disclosed as sample forms of implementing the claimed subject matter.

What is claimed is:

1. An apparatus comprising:

an antenna having a first portion and a second portion;

a switch coupled between the first portion and the second portion to cause the antenna to tune to a plurality of radio frequency bands and a diversity switch network coupled to the antenna to route a radio signal from a radio module to the antenna, wherein the diversity switch network is to operate in accordance with an identity matrix transformation.

2. The apparatus of claim 1, wherein the switch comprises one or more of: a pin diode, a field effect transistor, or a micro-electromechanical systems (MEMS) element.

3. The apparatus of claim 1, further comprising a processor to cause the switch to modify its state.

4. The apparatus of claim 1, wherein the first portion or the second portion are constructed with a material comprising one or more of: Aluminum, Copper, Gold, or combinations thereof.

5. The apparatus of claim 1, further comprising a switching control unit to control a state of the switch.

6. The apparatus of claim 1, further comprising a substrate to mechanically support the antenna and switch.

7. The apparatus of claim 1, wherein the antenna is one of: a monopole antenna, a planar inverted F antenna (PIFA), a slot antenna, a micro-strip patch antenna, or a fractal antenna.

8. The apparatus of claim 1, further comprising one or more of a processor, a memory, or a transceiver that are coupled to the antenna.

9. A method comprising:

determining whether an antenna is to be reconfigured;

modifying a state of one or more switches to cause the antenna to be tuned to a select radio frequency band; and storing one or more instructions on computer-readable to cause performance of one or more of the determining or the modifying operations.

10. The method of claim 9, further comprising generating one or more signals to control the state of the one or more switches.

11. The method of claim 9, wherein modifying the state of the one or more switches comprises electrically coupling a plurality of portions of the antenna via the one or more switches.

12. The method of claim 9, wherein modifying the state of the one or more switches comprises electrically decoupling a plurality of portions of the antenna via the one or more switches.

* * * * *